US008182401B2

(12) United States Patent
Clemons

(10) Patent No.: US 8,182,401 B2
(45) Date of Patent: May 22, 2012

(54) HAMMER MOTION EXERCISE DEVICE

(76) Inventor: Robert L. Clemons, San Antonio, TX (US)

( * ) Notice: Subject to any disclaimer, the term of this patent is extended or adjusted under 35 U.S.C. 154(b) by 0 days.

(21) Appl. No.: 12/822,128

(22) Filed: Jun. 23, 2010

(65) Prior Publication Data

US 2011/0152043 A1 Jun. 23, 2011

Related U.S. Application Data

(60) Provisional application No. 61/269,357, filed on Jun. 24, 2009.

(51) Int. Cl.
*A63B 69/00* (2006.01)
*A63B 69/36* (2006.01)

(52) U.S. Cl. ..... 482/83; 482/121

(58) Field of Classification Search ..... 482/83–90, 482/148, 121–129, 92; 473/446; 73/379.04
See application file for complete search history.

(56) References Cited

U.S. PATENT DOCUMENTS 2,871,016 A * 1/1959 Rapaport ..... 482/77
2,977,119 A * 3/1961 Lehfeldt et al. ..... 482/31
3,427,021 A * 2/1969 Donato ..... 482/83
4,516,769 A * 5/1985 Kopp ..... 473/423
4,641,834 A * 2/1987 Hegedus et al. ..... 482/83
5,072,932 A * 12/1991 Johnson ..... 482/128
5,152,733 A * 10/1992 Farenholtz et al. ..... 482/135
5,899,835 A * 5/1999 Puranda ..... 482/90
5,921,895 A * 7/1999 Lynch et al. ..... 482/83
6,093,119 A * 7/2000 Tipton ..... 473/438
6,149,554 A * 11/2000 Ferguson ..... 482/83
6,575,879 B1 * 6/2003 Harney et al. ..... 482/54
7,066,846 B2 * 6/2006 Horkan ..... 473/438
7,137,909 B2 * 11/2006 Ohle ..... 473/423
7,189,134 B2 * 3/2007 Nugent et al. ..... 446/74
7,527,567 B2 * 5/2009 Ohle ..... 473/422
7,645,221 B1 * 1/2010 Curry ..... 482/148
7,959,542 B1 * 6/2011 Trudeau ..... 482/83
2003/0060340 A1 * 3/2003 Freeman ..... 482/83

* cited by examiner

*Primary Examiner* — Stephen Crow
(74) *Attorney, Agent, or Firm* — Kammer Browning PLLC

(57) ABSTRACT

Embodiments herein include an impact-receiving member to receive an impact force imparted by a mass exerted by an exercise device user during a physical exercise workout session, a shock-absorbing mechanism to dissipate energy transferred from the mass exerted by the exercise device user, and a platform assembly to support the impact-receiving member and the shock-absorbing mechanism in a spatial orientation consistent with objectives of the physical exercise workout session.

6 Claims, 3 Drawing Sheets

HAMMER MOTION EXERCISE DEVICE

CROSS-REFERENCE TO RELATED APPLICATION

This application claims the benefit under Title 35 U.S. Code §119(e) of U.S. Provisional Patent Application Ser. No. 61/269,357 filed on Jun. 24, 2009, the full disclosure of which is incorporated herein by reference.

BACKGROUND OF THE INVENTION

1. Field of the Invention

Various embodiments described herein relate to physical exercise equipment and associated methods, including exercise devices to simulate wood-chopping and/or pile-driving and associated apparatus for reducing shock waves reflected back to an exercise device user performing an exercise workout session.

2. Description of the Related Art

A possible contributor to modern-day sedentary lifestyle is the absence of particular physical labor activities that once provided for the exercise of a wide range of specific human muscle groups in various sequences. For example, it is well known that chopping wood or performing pile driving activities exercises arm, shoulder, and/or back muscle groups in particular sequences. Currently available general purpose exercise machines may not exercise the same muscle groups in the same sequences as bygone-day physical labor activities once did. Current-day physical exercise workout regimens may therefor not provide the same physical exercise benefit as did previous commonplace work task environments.

SUMMARY OF THE INVENTION

Embodiments of the invention described herein and the various equivalents that may derive therefrom (collectively hereinafter "embodiments") facilitate the exercise of a wide range of specific human muscle groups in various sequences. Embodiments operate to absorb shock waves resulting from the impact of a mass swung by an individual at a target impact block during a physical exercise workout session. Absorption of the shock waves at the exercise device may decrease the reflection of energy associated with the shock waves back through the mass to the individual performing the workout session. Damage to joints and tendons may be decreased or prevented as a result.

DETAILED DESCRIPTION OF THE PREFERRED EMBODIMENTS

Figure 1:
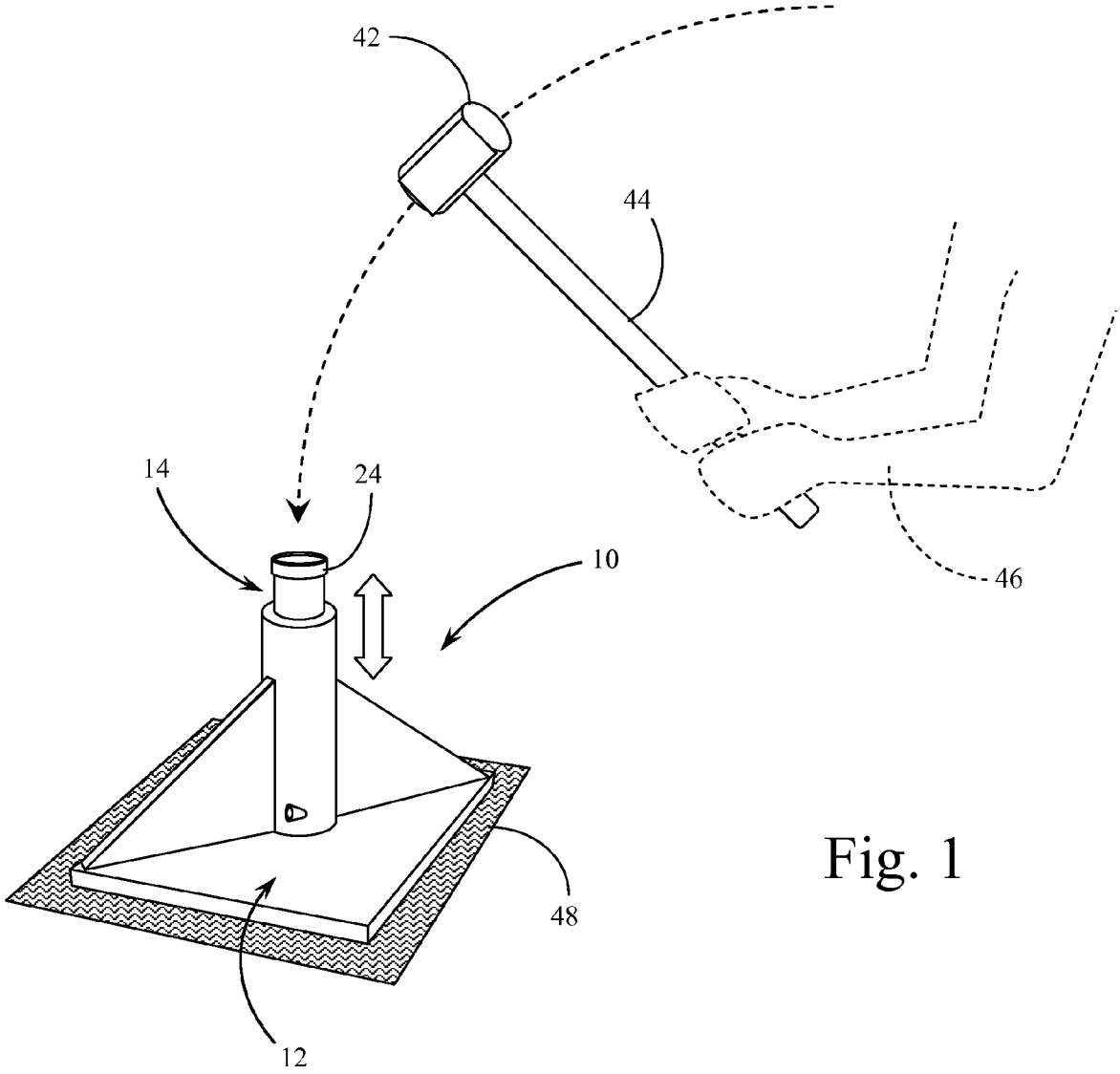
FIG. 1 is a perspective view showing the utilization of an exercise device by an individual swinging a mass according to various example embodiments of the present invention.

FIG. 1 is a perspective view showing the utilization of an exercise device 10 by an individual 46 swinging a mass 42 according to various example embodiments of the present invention.

It is noted that although example embodiments herein may be described in the context of an exercise device to be impacted by a mass swung by an individual during a physical exercise workout session, the subject matter of this disclosure applies generally to any type of shock-absorbing mechanism used to reduce the magnitude of shock wave reflections traveling back to a person exerting shock-producing forces on a physical device.

The exercise device 10 includes an impact absorbing assembly 14. The impact absorbing assembly 14 receives an impact force imparted by the mass 42 exerted by the person ("exercise device user") 46 during a physical exercise workout session. The exercise device user 46 may swing the mass 42 using a handle 44. The handle 44 may preferably be constructed from a solid material such as wood.

The exercise device 10 also includes an impact block 24 mechanically integrated with the impact absorbing assembly 14. The impact absorbing assembly 14 (described in more detail below) operates to dissipate energy transferred from the mass 42 as the mass 42 impacts the impact block 24. The impact absorbing assembly 14 may comprise one or more springs, hydraulic or pneumatic piston-and-cylinder mechanisms, flexible materials such as rubber or other polymers, or any other shock-absorbing material. Example embodiments of the impact absorbing assembly 14 are described in detail in subsequent portions of the present Detailed Description.

The exercise device 10 also includes a platform assembly 12 mechanically coupled to the impact absorbing assembly 14 and to the shock-absorbing mechanism incorporated therein. The platform assembly 12 supports the impact absorbing assembly 14 and the associated shock-absorbing mechanism in a spatial orientation consistent with at least one objective of the physical exercise workout session. For example, certain muscle groups may preferably be exercised via an overhand swing of the mass 42. This configuration may be facilitated by a vertical orientation of the impact absorbing assembly 14. Some embodiments may employ other angles of orientation according to the objectives of the physical workout session. In some embodiments, the platform assembly 12 may rest on a mat 48. The mat 48 may provide scuff protection for a floor and/or may provide additional shock absorption to the exercise device 10.

Figure 2:
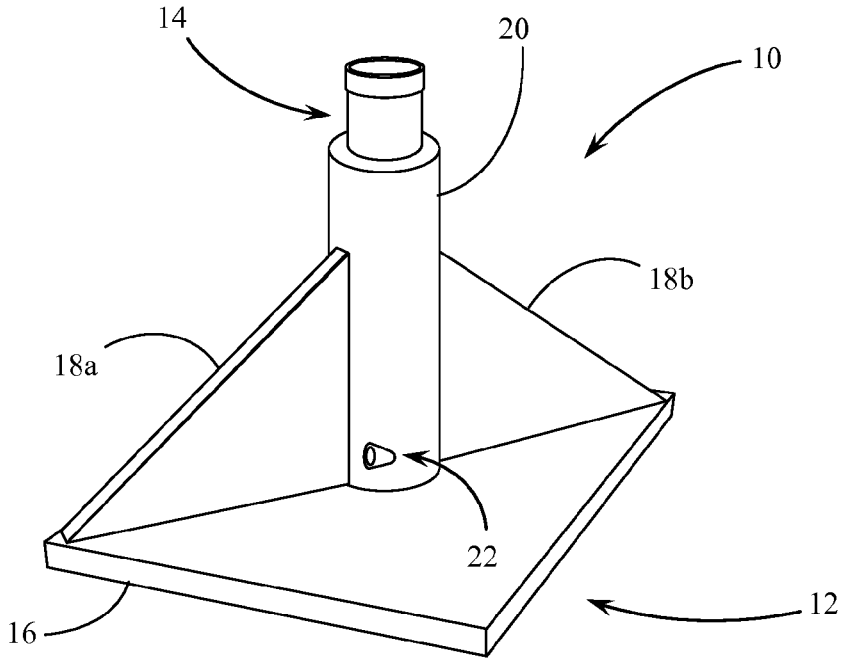
FIG. 2 is a perspective view of an exercise device according to various example embodiments of the present invention.
Figure 3:
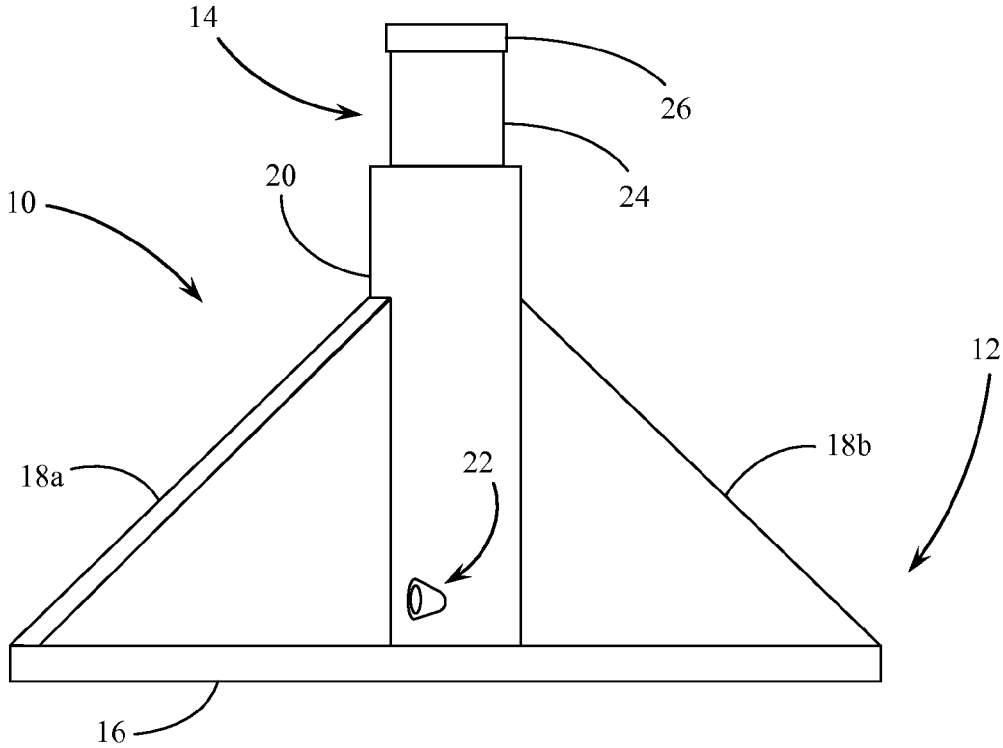
FIG. 3 is a side plan view of an exercise device according to various example embodiments of the present invention.

FIGS. 2 & 3 are a perspective view and a side-plan view, respectively, of the exercise device 10 according to various example embodiments of the present invention. The exercise device 10 includes impact absorbing assembly 14 which includes impact block 24, as previously mentioned. In some embodiments, the impact absorbing assembly 14 may comprise wooden, plastic, polymer, and/or metal materials.

The exercise device 10 may also include a containment band 26. The containment band 26 may entirely surround the impact block 24 along its length or along a portion thereof. The containment band 26 may prevent splintering of and/or compression damage to the impact absorbing assembly 14. The containment band 26 may be fabricated from metal, plastic or other polymer or suitable material.

The exercise device 10 also includes a platform assembly 12 as previously mentioned. The platform assembly 12 may include a cylindrical component 20 to house the impact absorbing assembly 14 as depicted on FIG. 1. A through-bolt 22 retains the impact absorbing assembly 14 in place relative to the cylindrical component 20.

The platform assembly 12 may also include a platform base component 16. The platform base component 16 is mechanically coupled to the cylindrical component 20 to provide support thereto. The platform assembly 12 may also include one or more support brackets 18*a* & 18*b*. The support brackets 18*a* & 18*b* are mechanically coupled to the cylindrical component 20 to maintain a selected orientation of the cylindrical component 20 relative to the platform base component 16. The support brackets 18*a* & 18*b* may, for example, maintain a perpendicular orientation of the cylindrical component 20 relative to the base component 16 in some embodiments.

Figure 4:
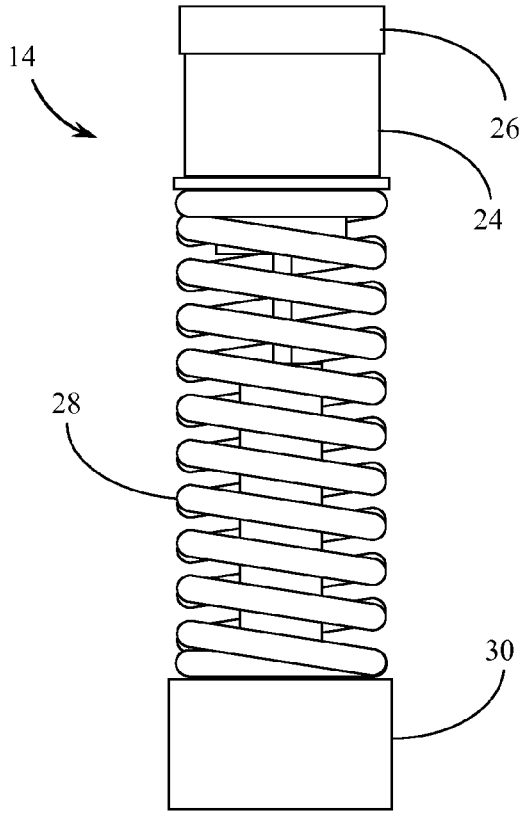
FIG. 4 is a fully assembled side plan view of a shock-absorbing mechanism associated with an exercise device according to various example embodiments of the present invention.
Figure 5:
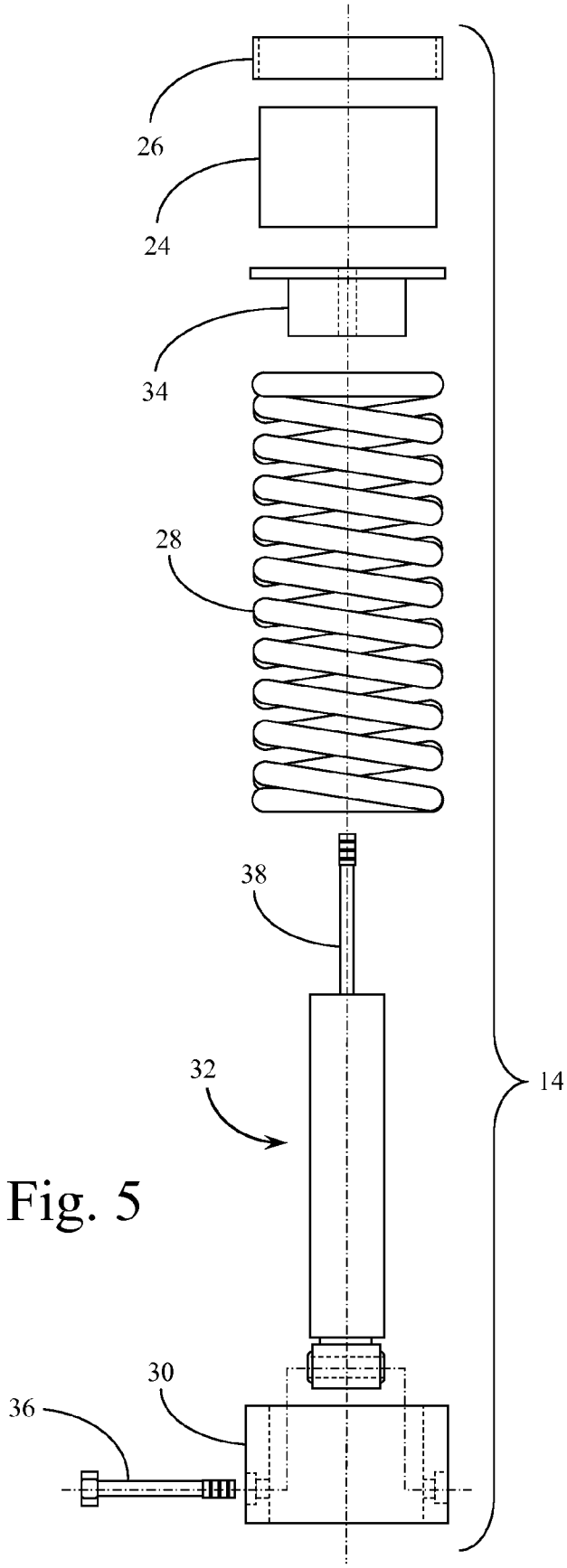
FIG. 5 is an exploded side view of a shock-absorbing mechanism associated with an exercise device according to various example embodiments of the present invention.

FIGS. 4 & 5 are a fully assembled side plan view and an exploded side view, respectively, of the impact absorbing assembly 14 associated with the exercise device 10 according to various example embodiments of the present invention. In some embodiments, the impact absorbing assembly 14 may include one or more of a coil spring 28 and/or a pneumatic or hydraulic piston-and-cylinder mechanism 32.

The impact absorbing assembly 14 may also include an upper cap component 34. The upper cap component 34 is mechanically coupled to the spring 28 and/or to the piston-and-cylinder mechanism 32 (e.g., threaded to the piston 38) to retain the spring 28 relative to the piston-and-cylinder mechanism 32. The upper cap component 34 is also mechanically coupled to the impact block 24 and transfers impact energy from the impact block 24 to shock-absorbing components of the impact absorbing assembly 14.

The impact absorbing assembly 14 may also include a lower internal assembly base 30. The lower internal assembly base 30 is mechanically coupled to the piston-and-cylinder mechanism 32 and to the platform assembly 12 via a through-bolt 36. The lower internal assembly base 30, through-bolt 36, and upper cap component 34 restrain a relaxed-state expansion of the impact absorbing assembly 14. In some embodiments, the upper cap component 34 may be threaded onto a piston rod 38 associated with the piston-and-cylinder mechanism 32.

In some embodiments, the exercise device 10 may also include a workout calculator (not shown) to display exercise progress made by the exercise device user over a selected period of time. The exercise progress may include total caloric energy expended over the selected period of time, the magnitude of a force exerted by an impact of the mass swung by the exercise device user, and other such metrics associated with an exercise workout session.

The apparatus and systems of various embodiments may be useful in applications other than an exercise device to be impacted by a mass swung by an individual during a physical exercise workout session. Thus, various embodiments of the invention are not to be so limited. The illustrations of the apparatus 10 are intended to provide a general understanding of the structure of various embodiments. They are not intended to serve as a complete description of all the elements and features of apparatus and systems that might make use of the structures described herein.

The novel apparatus of the various embodiments may comprise or be incorporated into various systems and methods associated with physical exercise, including residential, athletic, or gym exercise involving humans.

The apparatus and methods described herein operate to receive and absorb shock-producing mechanical forces received at an exercise device impacted by a mass swung by an individual during a physical exercise workout session. Shock wave reflections traveling back to the exercise device user and consequent damage to the individual's joints and tendons may be decreased or prevented as a result.

By way of illustration and not of limitation, the accompanying figures show specific embodiments in which the subject matter may be practiced. The embodiments illustrated are described in sufficient detail to enable those skilled in the art to practice the teachings disclosed herein. Other embodiments may be used and derived therefrom, such that structural and logical substitutions and changes may be made without departing from the scope of this disclosure. This Detailed Description, therefore, is not to be taken in a limiting sense. The breadth of various embodiments is defined by the appended claims and the full range of equivalents to which such claims are entitled.

Such embodiments of the inventive subject matter may be referred to herein individually or collectively by the term "invention" merely for convenience and without intending to voluntarily limit this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments.

The Abstract of the Disclosure is provided to comply with 37 C.F.R. §1.72(b) requiring an abstract that will allow the reader to quickly ascertain the nature of the technical disclosure. It is submitted with the understanding that it will not be used to interpret or limit the scope or meaning of the claims. In the preceding Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

I claim:

1. An exercise device, for placement on a horizontal support surface, the exercise device comprising:

a platform base member to support the exercise device on the horizontal support surface, the platform base member comprising a generally flat, horizontally oriented plate;

a cylindrical housing coupled to the platform base member in an orthogonal orientation with respect to the horizontally oriented plate;

an internal spring assembly within the cylindrical housing, the internal spring assembly comprising:

a piston-and-cylinder shock absorber;

a coil spring surrounding the piston-and-cylinder shock absorber;

an internal assembly base mechanically coupled to a through-bolt end of the piston-and-cylinder shock absorber and to the platform base member; and a coil spring cap threadably coupled to a threaded piston shaft component of the piston-and-cylinder shock absorber to retain components of the internal spring assembly; and an impact block mechanically coupled to the internal spring assembly to receive an impact force imparted by a mass exerted by an exercise device user during a physical exercise workout session.

2. The exercise device of claim 1, wherein the impact block comprises at least one of a wooden impact block, a plastic impact block, a polymer impact block, or a metal impact block.

3. The exercise device of claim 1, further comprising:

at least one support bracket mechanically coupled to the cylindrical housing to maintain the orthogonal orientation of the cylindrical housing relative to the platform base member.

4. The exercise device of claim 1, wherein the piston-and-cylinder shock absorber comprises at least one of a hydraulic mechanism or a pneumatic mechanism.

5. The exercise device of claim 1, further comprising:

an impact band surrounding at least a portion of the impact block to prevent compression damage to the impact block upon receiving the impact imparted by the mass.

6. The exercise device of claim 5, wherein the impact band comprises at least one of a metal structure, a polymer structure, or a plastic structure.

* * * * *